US007125187B2

(12) United States Patent
Osti

(10) Patent No.: US 7,125,187 B2
(45) Date of Patent: Oct. 24, 2006

(54) CLOSURE SYSTEM FOR A CONTAINER

(75) Inventor: Alois Osti, Cranford, NJ (US)

(73) Assignee: L'Oréal, S.A., Paris (FR)

( * ) Notice: Subject to any disclaimer, the term of this patent is extended or adjusted under 35 U.S.C. 154(b) by 274 days.

(21) Appl. No.: 10/327,974

(22) Filed: Dec. 26, 2002

(65) Prior Publication Data

US 2003/0141273 A1 Jul. 31, 2003

Related U.S. Application Data

(60) Provisional application No. 60/342,376, filed on Dec. 27, 2001.

(51) Int. Cl.
*B43M 11/00* (2006.01)
*A46B 11/00* (2006.01)
*B65D 39/00* (2006.01)

(52) U.S. Cl. ..... 401/128; 401/126; 215/294; 215/296

(58) Field of Classification Search ..... 401/126, 401/128, 129, 130; 215/355, 364, 273, 274, 215/294, 296, 317, 320; 222/545, 546
See application file for complete search history.

(56) References Cited

U.S. PATENT DOCUMENTS 2,509,369 A 5/1950 Roberson
3,204,836 A * 9/1965 Joffe ..... 222/545
3,207,377 A * 9/1965 Lemelson ..... 222/130
3,554,657 A * 1/1971 Aston ..... 401/122
3,670,915 A * 6/1972 Forman ..... 215/260
4,512,487 A 4/1985 Augros
5,400,926 A * 3/1995 Keller ..... 222/327
5,836,484 A * 11/1998 Gerber ..... 222/494
5,971,225 A * 10/1999 Kapsa ..... 222/212

FOREIGN PATENT DOCUMENTS

FR 2 259 761 8/1976
FR 0 186 548 7/1986

* cited by examiner

*Primary Examiner*—David J. Walczak
(74) *Attorney, Agent, or Firm*—Finnegan Henderson Farabow Garrett & Dunner, L.L.P.

(57) ABSTRACT

An exemplary embodiment of a closure system for a container comprises a sealing member and a stopper. The sealing member comprises a flange, an inner sleeve extending from the flange, and an outer sleeve surrounding the inner sleeve. The outer sleeve extends from the flange and is configured to be inserted into a container. The stopper is configured to be removably inserted into the inner sleeve.

91 Claims, 4 Drawing Sheets

CLOSURE SYSTEM FOR A CONTAINER

This application claims the benefit of U.S. provisional application No. 60/342,376, filed Dec. 27, 2001, which is incorporated herein by reference.

The invention relates to a closure system for a container. In one exemplary embodiment, the system includes a stopper sealing a neck of a container without leaving a gap between a top surface of the neck and a bottom surface of the stopper.

Conventional closure systems for containers include insertable, interference-fit closures, snap-fit closures, screw-on closures, and the like. For example, conventional interference-fit closures include a stopper insertable into a neck opening of a container to seal the container and prevent product from escaping the container. These conventional interference-fit closures typically include an elastomeric, or otherwise deformable, stopper. The stopper and/or the neck opening may be tapered to facilitate insertion of the stopper into the neck opening. During insertion of the stopper into the neck opening, an exterior surface of the stopper forms an interference fit with an interior surface of the neck opening at a region where the outside diameter of the stopper equals or slightly exceeds the inside diameter of the neck opening.

To ensure that a conventional interference-fit closure may be removed from a container, one end of the stopper is typically large enough so that it cannot be inserted into the container neck along with the remainder of the stopper. As a result, this large end of the stopper typically protrudes from the neck of the container so that it may be grasped by a user.

Some conventional interference-fit closures may include a closure member having a uniquely-configured portion that extends from the large end of a stopper. This portion of the closure member may serve an aesthetic and/or a functional purpose. For example, a closure member may have an enlarged decorative portion that extends radially outward to cover the top of the container neck and the region where the stopper forms a seal with the neck opening. In another example, the portion of the closure member extending from the large end of the stopper may be contoured to improve gripping of the closure member during removal of the stopper from the container neck. In addition, the closure member may be configured in a visually pleasing shape, color, texture, or the like and may include various indicia to attract consumers and/or induce sales.

In a substantial number of closure arrangements having an enlarged portion extending from a stopper, the enlarged portion of the closure member becomes spaced from the top of the container neck when the stopper is in a sealed position in the container neck. Often times, this spacing between the closure and the container neck forms a gap visible to an individual viewing a packaging arrangement incorporating this structure. While such a gap is acceptable in certain circumstances, the elimination of the gap could improve the aesthetic appearance of the packaging, especially when the packaging is intended to be decorative.

According to one aspect of the invention, a closure system for a container may comprise a sealing member and a stopper. The sealing member may comprise a flange, an inner sleeve extending from the flange, and an outer sleeve surrounding the inner sleeve. The outer sleeve may extend from the flange and may be configured to be placed in a container. The stopper may be configured to be removably inserted into the inner sleeve.

According to yet another aspect of the invention, a closure system for use with a container may comprise a first member comprising an elastically-deformable first sleeve surrounding an elastically-deformable second sleeve. The first and second sleeves may be configured to be placed in a container, and the first sleeve may be configured to cooperate with the container to form a fluidtight seal. The system may also comprises a stopper configured to be sealingly-inserted into the second sleeve.

According to still a further aspect of the invention, a closure system for use with a container having a neck may comprise an insert configured to be placed in the neck. The insert may have a first sleeve surrounding a second sleeve. The first sleeve may be forced toward the second sleeve when the insert is placed in the neck. The system may also include a stopper configured to be removably inserted into the insert. The second sleeve may be forced toward the first sleeve while the stopper is inserted into the insert.

It is to be understood that both the foregoing general description and the following detailed description are exemplary and explanatory only and are not restrictive of the invention.

The accompanying drawings are included to provide a further understanding of the invention and are incorporated in and constitute a part of this specification. The drawings illustrate exemplary embodiments of the invention and, together with the description, serve to explain certain principles. In the drawings FIG. 1 is an exploded, cross-sectional view of a closure system in accordance with a first exemplary embodiment;

Figure 1:
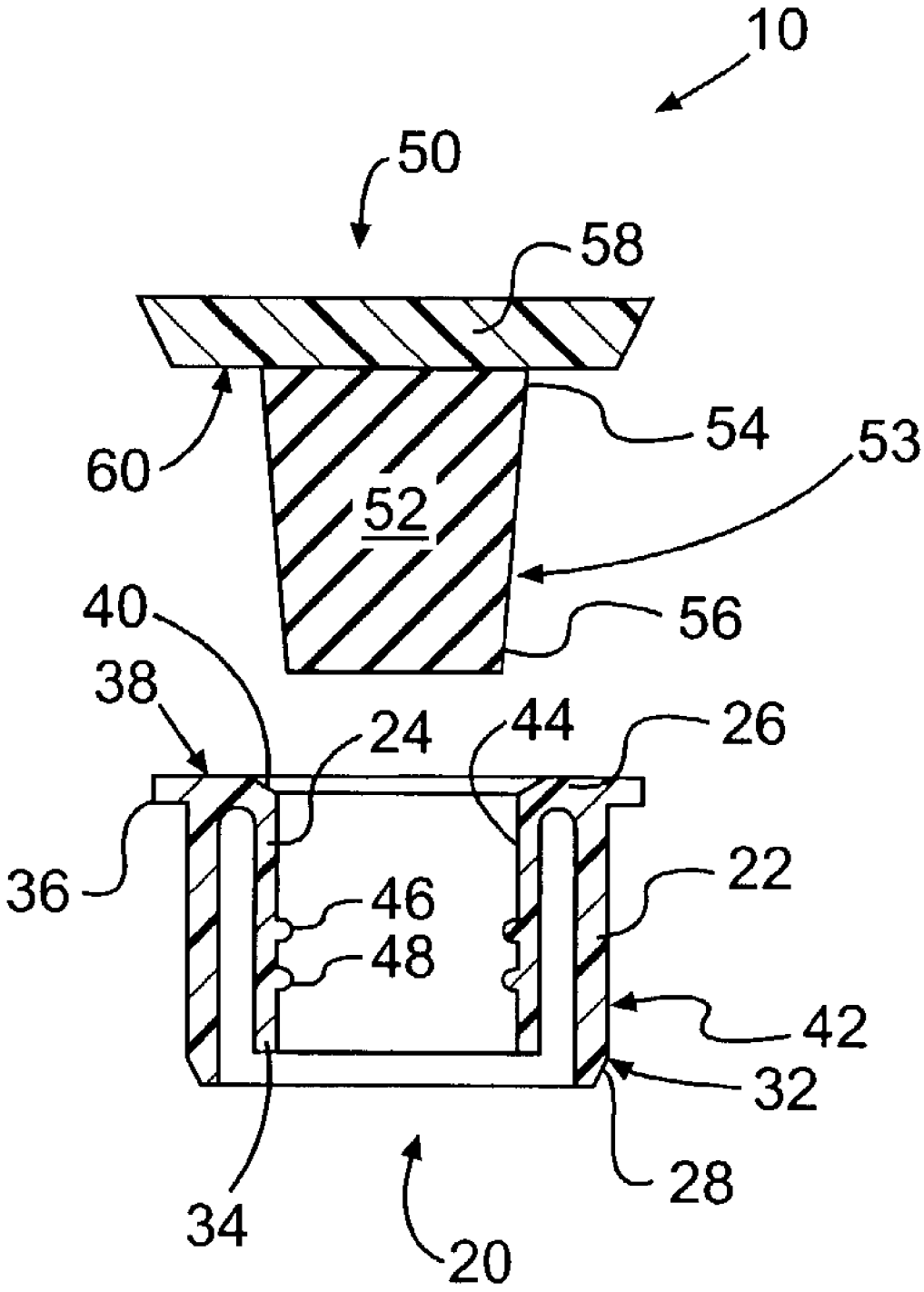

Reference will now be made in detail to exemplary embodiments of the invention, examples of which are illustrated in the accompanying drawings. Wherever possible, the same reference numbers will be used throughout the drawings to refer to the same or like parts. In addition, reference numerals, differing by one hundred or two hundred (i.e., having the same final two digits) will be used to refer to similar elements.

Figure 2:
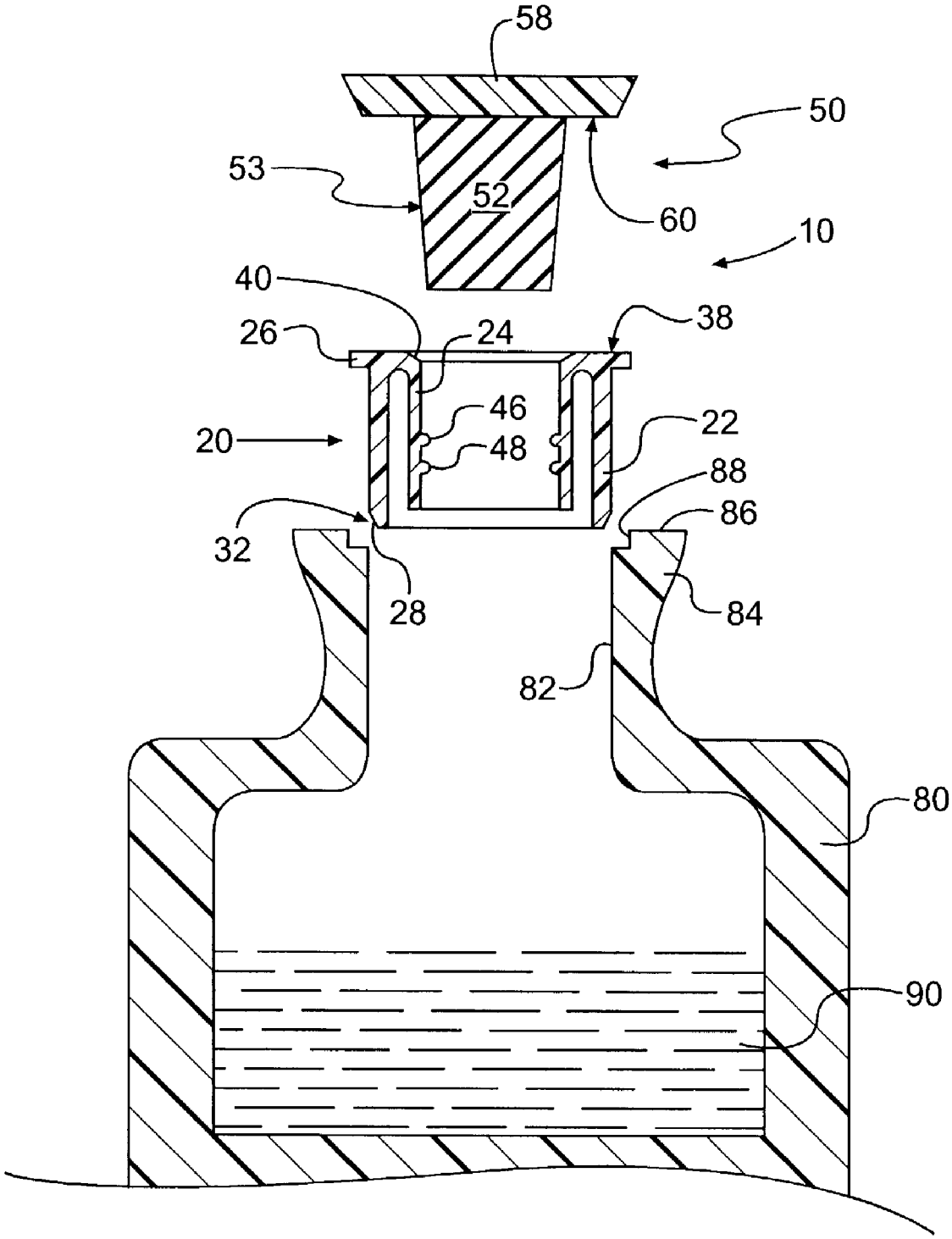
FIG. 2 is an exploded, cross-sectional view of the closure system of FIG. 1 in combination with a container.

In accordance with the invention, a closure system for a container is provided. Referring to FIG. 1, a closure system 10 may include an insert 20 and a closure member 50. The insert 20 may be configured to be inserted into a container 80, as shown in FIG. 2, and the closure member 50 may be configured to be inserted into the insert 20. The insert 20 may, for example, be formed of a material such as polypropylene or polyethylene. The container 80 may comprise a bottle, for example, a glass bottle. Alternatively, the bottle may be formed of other rigid materials, which may be transparent or translucent.

The insert 20 may include a first, outer sleeve 22, a second, inner sleeve 24, and a flange 26. The first sleeve 22 and the second sleeve 24 may each extend from the flange 26, with the first sleeve 22 spaced from and surrounding the second sleeve 24. As shown in the cross-sectional view of FIG. 1, the first and second sleeves 22, 24 may be arranged substantially parallel to one another. The first sleeve 22 and the second sleeve 24 may each have a free end 32, 34 opposite to the flange 26.

An outer surface 42 of the first sleeve 22 may have a sloped surface 28 at the free end 32, and the second sleeve 24 may have one or more projections 46, 48 extending inward from an inner surface 44 of the second sleeve 24. The projections 46, 48 may comprise continuous ridges extending completely around the inner surface 44 of the second sleeve 24. Alternatively, the projections could extend only partially along the inner sleeve surface. As shown in the exemplary embodiment of FIGS. 1 and 2, the projection 48 further from the flange 26 may be slightly larger than the projection 46 closer to the flange 26.

The first and second sleeves 22, 24 may be cylindrical, or any shape that complements an opening 82 in the container 80. The first and second sleeves 22, 24 may be formed of an elastomeric material, such that the first sleeve 22 and the second sleeve 24 may be deflected relatively toward one another when the insert 20 is in container 80 and when closure member 50 is in the insert 20. In an alternative embodiment (not shown), the first and second sleeves 22, 24 may be connected at their ends opposite the flange 26, wherein the connection could be sufficiently flexible to allow the first and second sleeves 22,24 to be deflected relatively toward one another. In another alternative embodiment (not shown), the sleeves may be comprised of multiple segments separated from one another by spaces at least prior to placing the insert in the container neck.

The flange 26 may include an extension portion 36 that extends radially outward beyond an outer surface of the first sleeve 22. The flange 26 may also include a top end surface 38 opposite to the first and second sleeves 22, 24. The end surface 38 may comprise a sloped portion 40 positioned at an innermost region of the flange 26.

As shown in FIGS. 1 and 2, the sleeves 22, 24 and flange 26 may be formed in an integral arrangement from a single piece of material, such as elastomeric material. Alternatively, certain portions of the insert could be separate pieces connected to one another and/or formed of differing materials.

The closure member 50 may include a stopper 52 configured to be inserted into the insert 20. The stopper 52 may comprise an outer surface 53 optionally tapered for at least a portion of the distance from a first, large end 54 to a second small end 56. The closure member 50 may also include a top portion 58 extending from the large end 54 of the stopper 52. The top portion 58 may include a shoulder 60 having a lower surface facing in the same direction as the bottom of the stopper 52. Optionally, the top portion 58 may extend directly from the stopper 52.

The second sleeve 24 of the insert 20 may be structured and arranged to insertably receive the stopper 52. The distance between opposed inner portions of the projection 46 and the projection 48 may be substantially the same as, or slightly smaller than, the outer dimension of the stopper 52. When the stopper has a generally circular cross-section, the outer dimension may comprise, for example, an outer diameter.

The container 80 may include a neck 84 defining the opening 82. The neck 84 may include a top end surface 86 comprising a cutout portion 88. The cutout portion 88 may be structured and arranged to receive the flange 26 of the insert 20. For example, when the first sleeve 26 and the opening 82 are substantially cylindrical, the inner dimension of the opening 82 may be sized substantially the same as, or slightly smaller than, the outer dimension of the first sleeve 22. When the first sleeve 26 has a generally circular outer cross-section and the neck opening 82 has a generally circular inner cross-section, the inner and outer dimensions may comprise, for example, inner and outer diameters, respectively.

Figure 3:
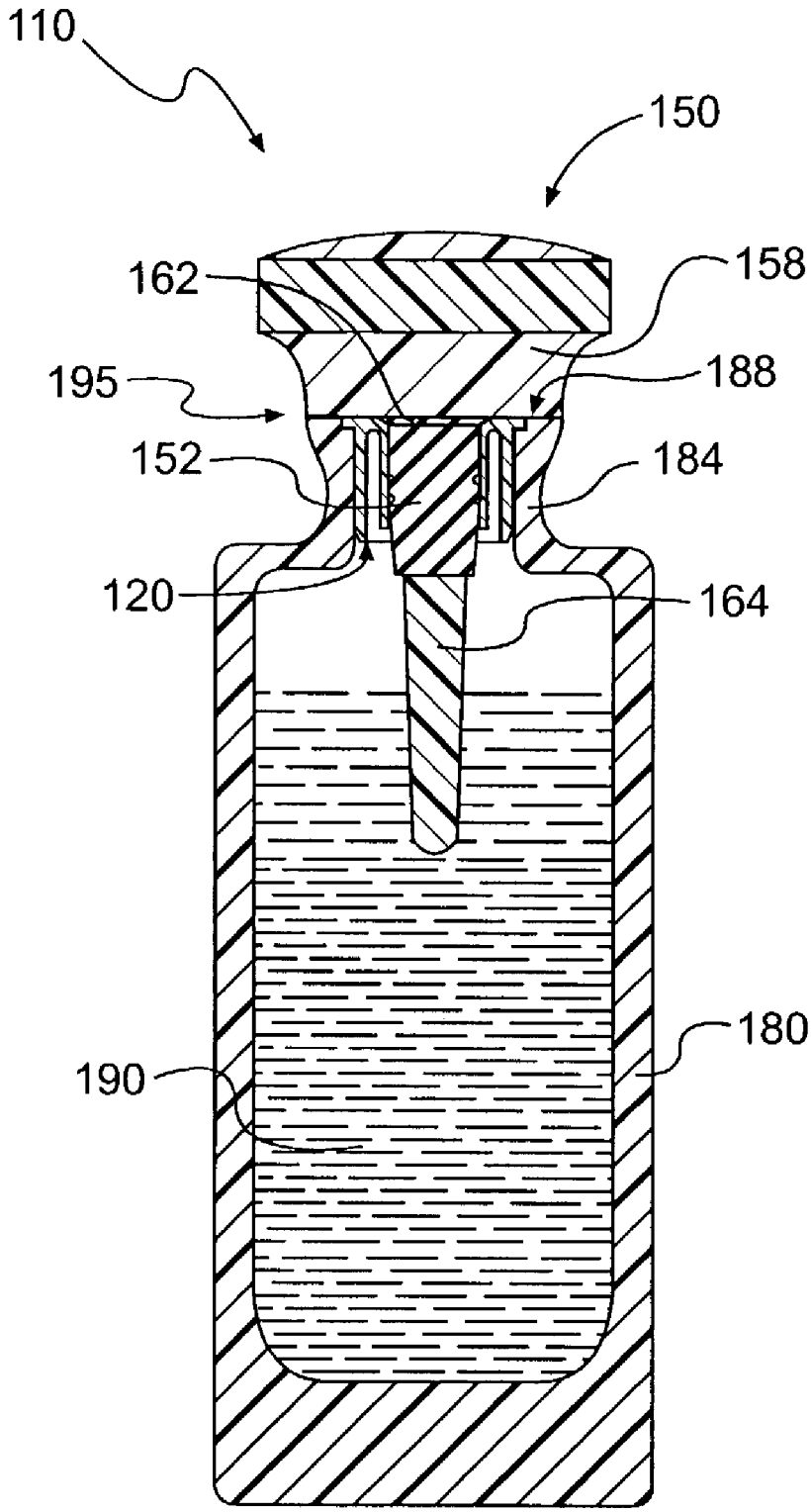
FIG. 3 is a cross-sectional view of a closure system in accordance with another exemplary embodiment in combination with a container.

Referring to FIG. 3, an alternative embodiment of a closure system 110 may incorporate an insert 120 configured in the same manner as the insert shown in FIGS. 1 and 2. Further, the system 110 may include a closure member 150 including a top portion 158, a stopper 152, and a dabber 164 extending from the stopper 152. The dabber 164 may be formed of glass material, for example, a ground glass material. As shown in FIG. 3, optionally, the top portion 158 of the closure member 150 may be connected to the stopper 152 by a transitional portion 162 of the closure member 150.

In the exemplary embodiment of FIG. 3, the dabber 164 has a length sufficient to place it in contact with product 190 contained in a container 180 when the stopper 152 is fully inserted into the insert 120. The dabber 164 could be configured so that surface tension retains product on the dabber 164 for at least a period of time after the dapper is withdrawn from the container 180. The dabber 164 may be used to apply the product 190, for example, a cosmetic product such as a perfume, cologne, eau de toilette, and the like, to a surface region (e.g., skin) of a user. Optionally, the top portion 158 may be configured to facilitate gripping of the closure member 150 during removal from the insert 120 and/or to provide aesthetic design.

Figure 4:
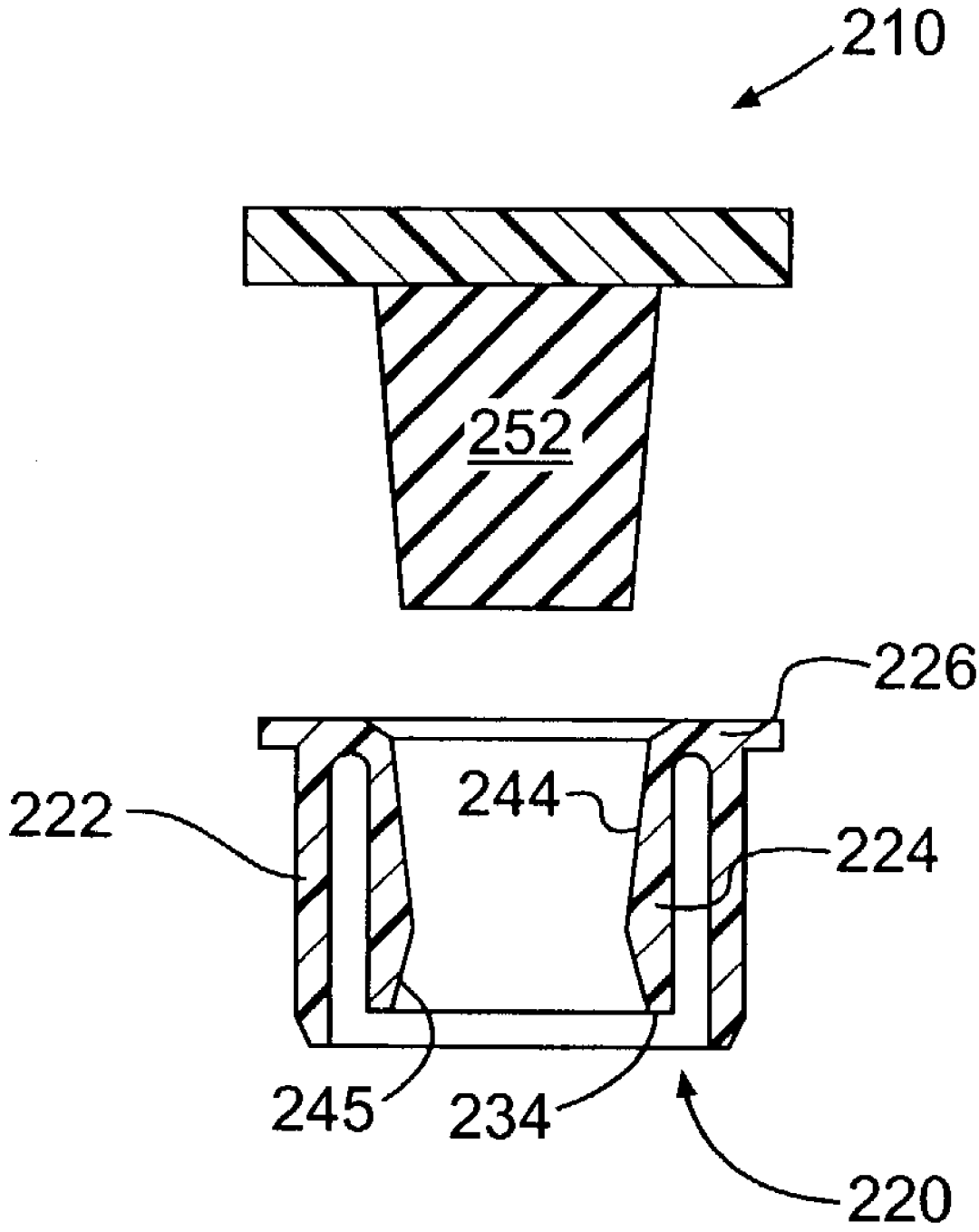
FIG. 4 is a cross-sectional view of an alternate embodiment of a closure system.

According to another exemplary embodiment, as shown in FIG. 4, an insert 220 of a closure system 210 may comprise a flange 226 and outer sleeve 222 along with an inner sleeve 224 having an inner surface 244 that tapers from the flange 226 toward its free end 234. The tapered inner surface 244 facilitates an interference fit relationship with a stopper 252. A sloped surface 245 could be arranged between the tapered inner surface 244 and the free end 234.

In use, the closure system 10 may be employed, for example, in the opening 82 in the neck 84 of a container 80, as shown in FIG. 2. In an exemplary embodiment, the sloped surface 28 at the free end 32 of the first sleeve 22 may facilitate insertion of the insert 20 into the opening 82. The insert 20 may be inserted into the opening 82 until the flange 26 is received by the cutout portion 88 in the neck 84. When received by the cutout portion 88, an end surface 38 of the flange 26 may be flush (e.g., substantially parallel) with the top end surface 86 of the neck 84.

When the opening 82 has a dimension slightly smaller than the outer dimension of the first sleeve 22, the first sleeve 22 deflects toward the second sleeve 24 as the insert 20 is inserted into the opening 82. For example, the difference between the inner dimension of the opening 82 and the outer dimension of the first sleeve 22 could be sufficiently large to create an interference fit between the insert 20 and the neck 84 and thereby provide a fluidtight seal therebetween. The difference could also be small enough so that the first sleeve 22 does not deflect far enough toward the second sleeve 24 to prevent the second sleeve 24 from deflecting outward toward the first sleeve 22 while the stopper 52 is inserted in the second sleeve 24. Thus, the second sleeve 24 may be deflected outwardly and conform to the outer surface 53 of the stopper 52 when the stopper 52 is inserted into the insert 20 such that the second sleeve forms a fluidtight seal with the stopper 52.

The closure member 50 may be inserted into the insert 20 at any time, such as while the insert 20 is inserted in the opening 82 in the container 80 or even before the insert 20 is inserted. The tapered stopper 52 and/or the sloped portion 40 at the end surface 38 of the flange 26 may facilitate insertion of the stopper 52 into the insert 20.

As the stopper 52 is inserted further into the insert 20, the outer surface 53 of the stopper 52 engages the projections 46, 48 on the inner sleeve surface 44. The slightly smaller distance between opposed inner portions of the projection 46 and the projection 48 with respect to the outer dimension of the stopper 52 causes the second sleeve 24 to deflect toward the first sleeve 22 as the stopper 52 is inserted into the insert 20.

The difference between the inner dimension of the projections 46, 48 and the outer dimension of the stopper 52 may be sufficiently large to create an interference fit (i.e., gripping force) between the insert 20 and the stopper 52 to provide a fluidtight seal therebetween. The difference may also be small enough that the second sleeve 24 will not deflect outwardly far enough to make contact with the first sleeve 22. In an exemplary embodiment, the projection 48 further from the flange 26 may be larger than the projection 46 closer to the flange 26 to improve the interference fit between the stopper 52 and the insert 20.

As a result of the ability of the first and second sleeves 22, 24 to deflect relatively toward one another and conform to the neck opening 82 and the stopper 52, respectively, the insert 20 may achieve an interference fit with both the container 80 and the stopper 52. In addition, because of the ability of the first and second sleeves 22, 24 to deflect toward one another while maintaining fluidtight seals, the stopper 52 may be inserted into the insert 20 until the shoulder 60 of the top portion 58 of the closure member 50 contacts the end surface 88 of the neck 84 of the container 80.

For example, as shown in FIG. 3, the contact region 195 between the top portion 158 and an end surface 188 of a container neck 184 might lack a gap visible to a consumer viewing the arrangement. In one exemplary embodiment, such a zero-gap contact region 195 might enable the closure member 150 and the container neck 184 to resemble a single piece construction.

It will be apparent to those skilled in the art that various modifications and variations can be made to the structure described herein. Thus, it should be understood that the invention is not limited to the examples discussed in the specification. Rather, the present invention is intended to cover modifications and variations.

What is claimed is:

1. A closure system for a container, comprising:

a sealing member comprising a flange, an inner sleeve extending from the flange, and an outer sleeve surrounding the inner sleeve, the outer sleeve extending from the flange and being configured to be fixedly placed in a container; and a stopper configured to be removably and sealingly inserted into the inner sleeve, wherein the outer sleeve is constructed to have an outer diameter that is substantially the same as an inner diameter of a portion of the container, wherein the flange comprises an extension portion extending radially outward beyond an outer surface of the outer sleeve, such that the extension portion and the outer sleeve complement the portion of the container so as to be fixedly placed with respect to the portion of the container, and wherein the inner sleeve deflects toward the outer sleeve when the stopper is inserted into the sealing member.

2. The system of claim 1, further comprising at least one projection extending from an inner surface of the inner sleeve.

3. The system of claim 2, wherein the at least one projection comprises a continuous ridge extending circumferentially around the inner surface of the inner sleeve.

4. A closure system for a container, comprising:

sealing member comprising a flange, an inner sleeve extending from the flange, at least one protection extending from an inner surface of the inner sleeve, and an outer sleeve surrounding the inner sleeve, the outer sleeve extending from the flange and being configured to be fixedly placed in a container;

a stopper configured to be removably and sealingly inserted into the inner sleeve, wherein the outer sleeve is constructed to have an outer diameter that is substantially the same as an inner diameter of a portion of the container, wherein the flange comprises an extension portion extending radially outward beyond an outer surface of the outer sleeve, such that the extension portion and the outer sleeve complement the portion of the container so as to be fixedly placed with respect to the portion of the container, and wherein the at least one projection is structured and arranged to engage the stopper in an interference fit relationship to provide a fluidtight seal when the stopper is inserted into the inner sleeve.

5. The system of claim 1, further comprising a first ridge and a second ridge each extending circumferentially around the inner surface of the inner sleeve, wherein the first ridge is closer to the flange than the second ridge and the second ridge extends further inward from the inner surface than the first ridge.

6. The system of claim 1, wherein the inner sleeve defines an inner surface tapering from the flange.

7. The system of claim 1, wherein the stopper is tapered.

8. The system of claim 1, further comprising a closure member.

9. The system of claim 8, wherein the closure member comprises the stopper and a dabber extending from the stopper.

10. The system of claim 9, wherein the closure member further comprises a top portion extending from the stopper in a direction opposite to the dabber.

11. The system of claim 1, wherein the inner sleeve and the outer sleeve each have a free end opposite to the flange.

12. The system of claim 11, wherein the inner sleeve and the outer sleeve each comprise elastomeric material.

13. An apparatus comprising:

a container configured to contain a product; and a closure system associated with the container, the closure system comprising a sealing member comprising a flange, an inner sleeve extending from the flange, and an outer sleeve surrounding the inner sleeve, the outer sleeve extending from the flange and being fixedly placed in the container;

a stopper configured to be removably and sealingly inserted into the inner sleeve, wherein the inner sleeve deflects toward the outer sleeve when the stopper is inserted into the sealing member.

14. The apparatus of claim 13, further comprising a product in the container.

15. The apparatus of claim 14, wherein the product comprises one of a cosmetic product and a care product.

16. The apparatus of claim 14, wherein the product comprises a fragrance.

17. The apparatus of claim 13, wherein the container comprises a bottle.

18. The apparatus of claim 17, wherein the bottle comprises glass.

19. The apparatus of claim 13, wherein the container comprises a neck with an opening.

20. The apparatus of claim 19, wherein the neck comprises a cutout configured to receive the flange.

21. The apparatus of claim 19, wherein the neck is structured and arranged to engage the outer sleeve in an interference fit relationship to provide a fluidtight seal when the outer sleeve is inserted into the opening.

22. The apparatus of claim 19, wherein the inner sleeve and the outer sleeve each have a free end opposite to the flange.

23. The apparatus of claim 22, wherein the outer sleeve deflects toward the inner sleeve when the sealing member is inserted in the opening.

24. The apparatus of claim 13, further comprising a closure member.

25. The apparatus of claim 24, wherein the closure member comprises the stopper and a dabber extending from the stopper.

26. The apparatus of claim 25, wherein the closure member further comprises a top portion extending from the stopper in a direction opposite to the dabber.

27. The apparatus of claim 26, wherein the top portion engages the flange while the stopper maintains a fluidtight seal with the inner sleeve.

28. The apparatus of claim 27, wherein the container comprises a neck and the top portion engages the neck while the outer sleeve maintains a fluidtight seal with the neck.

29. A closure system for use with a container having a neck, comprising:

an insert configured to be placed in a neck of a container, the insert comprising a first sleeve and a second sleeve, the first sleeve surrounding the second sleeve and being forced toward the second sleeve while the insert is placed in the neck; and a stopper configured to be removably inserted into the insert, the second sleeve being forced toward the first sleeve while the stopper is inserted into the insert.

30. The system of claim 29, wherein the first sleeve is constructed to have an outer diameter that is substantially the same as an inner diameter of the neck, and wherein the insert further comprises a flange having an extension portion extending radially outward beyond an outer surface of the first sleeve, such that the extension portion and the first sleeve complement the neck of the container so as to be fixedly placed with respect to the neck.

31. The system of claim 29, wherein the insert comprises a flange, and at least one of the first and second sleeves extends from the flange in a direction facing an interior of the container configured to contain a product.

32. The system of claim 29, further comprising at least one projection extending from an inner surface of the second sleeve.

33. The system of claim 32, wherein the at least one projection comprises a continuous ridge extending circumferentially around the inner surface of the second sleeve.

34. The system of claim 32, wherein the at least one projection is structured and arranged to engage the stopper in an interference fit relationship to provide a fluidtight seal when the stopper is inserted into the second sleeve.

35. The system of claim 29, further comprising a first ridge and a second ridge each extending circumferentially around the inner surface of the second sleeve, wherein the first ridge is closer to the flange than the second ridge and the second ridge extends further inward from the inner surface than the first ridge.

36. The system of claim 29, wherein the second sleeve defines an inner surface tapering from the flange.

37. The system of claim 29, wherein the stopper is tapered.

38. The system of claim 29, further comprising a closure member.

39. The system of claim 38, wherein the closure member comprises the stopper and a dabber extending from the stopper.

40. The system of claim 39, wherein the closure member further comprises a top portion extending from the stopper in a direction opposite to the dabber.

41. The system of claim 29, wherein the insert comprises a flange, and wherein the second sleeve and the first sleeve each have a free end opposite to the flange.

42. The system of claim 41, wherein the second sleeve deflects toward the first sleeve when the stopper is inserted into the insert.

43. The system of claim 41, wherein the second sleeve and the first sleeve each comprise elastomeric material.

44. An apparatus comprising:

a container configured to contain a product, the container having a neck; and a closure system associated with the container, the closure system comprising an insert fixedly placed in the neck of the container, the insert comprising a first sleeve and a second sleeve, the first sleeve surrounding the second sleeve and being forced toward the second sleeve while the insert is placed in the neck; and a stopper configured to be removably inserted into the insert, the second sleeve being forced toward the first sleeve while the stopper is inserted into the insert.

45. The apparatus of claim 44, further comprising a product in the container.

46. The apparatus of claim 45, wherein the product comprises one of a cosmetic product and a care product.

47. The apparatus of claim 45, wherein the product comprises a fragrance.

48. The apparatus of claim 44, wherein the container comprises a bottle.

49. The apparatus of claim 48, wherein the bottle comprises glass.

50. The apparatus of claim 44, wherein the container comprises a neck with an opening.

51. The apparatus of claim 50, wherein the neck comprises a cutout configured to receive the flange.

52. The apparatus of claim 50, wherein the neck is structured and arranged to engage the first sleeve in an interference fit relationship to provide a fluidtight seal when the first sleeve is inserted into the opening.

53. The apparatus of claim 50, wherein the insert comprises a flange, and wherein the second sleeve and the first sleeve each have a free end opposite to the flange.

54. The apparatus of claim 53, wherein the first sleeve deflects toward the second sleeve when the insert is placed in the opening.

55. The apparatus of claim 54, wherein the second sleeve deflects toward the first sleeve when the stopper is inserted into the insert.

56. The apparatus of claim 44, further comprising a closure member.

57. The apparatus of claim 56, wherein the closure member comprises the stopper and a dabber extending from the stopper.

58. The apparatus of claim 57, wherein the closure member further comprises a top portion extending from the stopper in a direction opposite to the dabber.

59. The apparatus of claim 58, wherein the insert comprises a flange and the top portion engages the flange while the stopper maintains a fluidtight seal with the second sleeve.

60. The apparatus of claim 59, wherein the container comprises a neck and the top portion engages the neck while the first sleeve maintains a fluidtight seal with the neck.

61. A closure system for use with a container, comprising:

a first member comprising an elastically-deflectable first sleeve and an elastically-deflectable second sleeve, the first and second sleeves being configured to be placed in a container, the first sleeve surrounding the second sleeve and being configured to cooperate with the container to form a fluidtight seal; and a stopper configured to be sealingly-inserted into the second sleeve, wherein the second sleeve deflects toward the first sleeve when the stopper is inserted into the first member.

62. The system of claim 61, wherein the first sleeve is constructed to have an outer diameter that is substantially the same as an inner diameter of a portion of the container, and wherein the first member further comprises a flange having an extension portion extending radially outward beyond an outer surface of the first sleeve, such that the extension portion and the first sleeve complement the portion of the container so as to be fixedly placed with respect to the portion of the container.

63. The system of claim 61, wherein the first member comprises a flange, and at least one of the first and second sleeves extends from the flange in a direction facing an interior of the container configured to contain a product.

64. The system of claim 61, further comprising at least one projection extending from an inner surface of the second sleeve.

65. The system of claim 64, wherein the at least one projection comprises a continuous ridge extending circumferentially around the inner surface of the second sleeve.

66. A closure system for use with a container, comprising:

a first member comprising an elastically-deflectable first sleeve and an elastically-deflectable second sleeve, the first and second sleeves being configured to be placed in a container, the first sleeve surrounding the second sleeve and being configured to cooperate with the container to form a fluidtight seal;

at least one protection extending from an inner surface of the second sleeve; and a stopper configured to be sealingly-inserted into the second sleeve, wherein the at least one projection is structured and arranged to engage the stopper in an interference fit relationship to provide a fluidtight seal when the stopper is inserted into the second sleeve.

67. The system of claim 61, further comprising:

a flange at one end of the first member; and a first ridge and a second ridge each extending circumferentially around the inner surface of the second sleeve, wherein the first ridge is closer to the flange than the second ridge and the second ridge extends further inward from the inner surface than the first ridge.

68. The system of claim 61, further comprising a flange at one end of the first member, wherein the second sleeve defines an inner surface tapering from the flange.

69. The system of claim 61, wherein the stopper is tapered.

70. The system of claim 61, further comprising a closure member.

71. The system of claim 70, wherein the closure member comprises the stopper and a dabber extending from the stopper.

72. The system of claim 71, wherein the closure member further comprises a top portion extending from the stopper in a direction opposite to the dabber.

73. The system of claim 61, further comprising a flange at one end of the first member, wherein the first sleeve and the second sleeve each have a free end opposite to the flange.

74. The system of claim 73, wherein the first sleeve and the second sleeve each comprise elastomeric material.

75. An apparatus comprising:

a container configured to contain a product; and a closure system associated with the container, the closure system comprising a first member comprising an elastically-deformable first sleeve and an elastically-deformable second sleeve, the first and second sleeves being fixedly placed in the container, the first sleeve surrounding the second sleeve and being configured to cooperate with the container to form a fluidtight seal, and a stopper configured to be sealingly-inserted into the second sleeve, wherein the second sleeve deflects toward the first sleeve when the stopper is inserted into the first member.

76. The apparatus of claim 75, further comprising a product in the container.

77. The apparatus of claim 76, wherein the product comprises one of a cosmetic product and a care product.

78. The apparatus of claim 76, wherein the product comprises a fragrance.

79. The apparatus of claim 75, wherein the container comprises a bottle.

80. The apparatus of claim 79, wherein the bottle comprises glass.

81. The apparatus of claim 75, wherein the container comprises a neck with an opening.

82. The apparatus of claim 81, further comprising a flange at one end of the first member, wherein the neck comprises a cutout configured to receive the flange.

83. The apparatus of claim 82, wherein the first sleeve and the second sleeve each have a free end opposite to the flange.

84. The apparatus of claim 81, wherein the first sleeve deflects toward the second sleeve when the first member is placed in the opening.

85. The apparatus of claim 81, wherein the neck is structured and arranged to engage the first sleeve in an interference fit relationship to provide a fluidtight seal when the first sleeve is placed in the opening.

86. The apparatus of claim 75, further comprising a closure member.

87. The apparatus of claim 86, wherein the closure member comprises the stopper and a dabber extending from the stopper.

88. The apparatus of claim 87, wherein the closure member further comprises a top portion extending from the stopper in a direction opposite to the dabber.

89. The apparatus of claim 88, wherein the top portion engages the first member while the stopper maintains a fluidtight seal with the second sleeve.

90. The apparatus of claim 89, wherein the container comprises a neck and the top portion engages the neck while the first sleeve maintains a fluidtight seal with the neck.

91. The system of claim 1, wherein the outer sleeve extends from the flange in a direction facing an interior of the container configured to contain a product.

* * * * *